United States Patent [19]

Flanagan, Jr.

[11] 3,936,912

[45] Feb. 10, 1976

[54] DEVICE AND SYSTEM FOR TIE-DOWN

[75] Inventor: Bill Flanagan, Jr., Houston, Tex.

[73] Assignee: Griffolyn Company, Inc., Houston, Tex.

[22] Filed: May 28, 1974

[21] Appl. No.: 473,563

[52] U.S. Cl. ..... 24/73 CF; 24/245 R; 135/15 CF

[51] Int. Cl.[2] ..... A44B 21/00; A45F 1/16

[58] Field of Search ..... 24/245 R, 73 CF, 73 PF, 24/30.5 T, 72.5, 16 PB, 73 ES; 135/15 CF

[56] References Cited

UNITED STATES PATENTS

| | | | |
|---|---|---|---|
| 568,986 | 10/1896 | Nagel | 24/72.5 |
| 1,237,930 | 8/1917 | Malvern et al. | 24/30.5 T UX |
| 1,401,340 | 12/1921 | Lindsay | 24/245 R |
| 2,004,702 | 6/1935 | Luttmann | 24/73 ES UX |
| 2,580,843 | 1/1952 | Sam | 24/73 ES UX |
| 2,939,468 | 6/1960 | Boyce | 135/15 CF |
| 3,283,383 | 11/1966 | Heath | 24/245 R |
| 3,467,999 | 9/1969 | Bjorksten et al. | 24/245 R |
| 3,535,746 | 10/1970 | Thomas | 24/30.5 T |
| 3,780,400 | 12/1973 | Hinsperger | 24/245 R X |

FOREIGN PATENTS OR APPLICATIONS

| | | | |
|---|---|---|---|
| 984,715 | 3/1965 | United Kingdom | 135/15 CF |
| 1,089,440 | 9/1954 | France | 24/16 PB |

*Primary Examiner*—Donald A. Griffin
*Attorney, Agent, or Firm*—Marvin B. Eickenroht; W. F. Hyer

[57] ABSTRACT

A system and a device for use in that system is provided for maintaining or tying down a flexible sheet material in a desired position. The device comprises a tie-down having two end portions connected by an elongate flexible link such that the end portions can be brought together by bending or flexing the link causing the latter to form a loop which can be secured to a scaffold bar or other anchor. The end portions are preferably hemispherical in shape and have surfaces which engage each other when the end portions are in their brought-together position. The end portions are substantially larger than the link so that when they are brought together and enveloped by the flexible sheet material, a cord or other securing means can be positioned at the juncture between the link and the brought-together end portions to secure the sheet material to the tie-down.

5 Claims, 4 Drawing Figures

DEVICE AND SYSTEM FOR TIE-DOWN

This invention relates to a system for covering articles with a flexible sheet material, especially a reinforced plastic material, wherein an improved tie-down can be attached to the sheet material at any point thereon. In another aspect, it relates to a device adapted to be used to tie down such sheet material.

Heretofore many types of devices have been suggested for tying down sheet material. Some of these, such as grommets, are installed at the factory thereby limiting the choice of tie-down locations in the field. Also, they cannot be successfully used with relatively thin plastic sheet materials, such as polyolefin films even when reinforced with fibers. Another type of tie-down, such as shown in Bjorksten et al, U.S. Pat. No. 3,467,999, has the advantage of being attachable in the field to a sheet material at any point thereon. While the Bjorksten et al type of tie-down has been used successfully in many locations, some problems have been encountered with it, especially in locations where the sheet material is subject to buffeting by wind.

An object of this invention is to provide a system for covering articles or openings wherein the tie-down can be attached to a flexible sheet material, especially one made from plastic film, at any selected point on the material in a manner such that the stress in the sheet material in the locus of the tie-down is distributed over a relatively large area to reduce the likelihood of the tie-down being torn from the sheet material.

Another object is to provide such a system in which the tie-down affords shock absorption, such as might be caused by winds buffeting the sheet material, to reduce the peak stresses in the sheet material at the locale of the tie-down.

Another object is to provide such a system wherein the tie-downs per se can be directly attached to structural elements, such as scaffold bars, already present in the article to be covered.

Another object is to provide such a system employing a tie-down device of such configuration that it can be made as a single piece and then attached to the sheet material using other elements which are readily available in the field.

Another object is to provide a tie-down device per se which is usable in the systems of the foregoing objects.

These and other objects and advantages of the invention will become more apparent to one skilled in the art upon consideration of the specification, the claims and the attached drawings wherein:

In accordance with this invention, a system is provided for covering articles or openings with a flexible sheet material adapted to be held in position by a binding means including a tie-down device secured thereto. The tie-down device has two spaced-apart end portions connected by a flexible link such that the end portions can be brought together by flexing the link which also causes the latter to form a loop. The end portions are substantially larger than the part of link adjacent thereto. The sheet material envelopes the end portions when the latter are in their brought-together positions and is secured to the tie-down device at the juncture between the brought-together end portions and the link, such as by tying a flexible cord around the sheet material at this juncture. By making the end portions with rounded outer surfaces, preferably with each in the shape of a hemisphere, and by making such portions of substantial size, a considerable area is provided so that when the sheet material is placed under a load, a correspondingly relatively large area of it is pressed against the end portions thereby reducing or minimizing stress concentrations in the sheet material. Also by making the flexible link out of a material which permits the link to be resiliently stretched lengthwise, the link tends to absorb shocks applied to the sheet material thereby again reducing or minimizing the stresses applied to the sheet material at the tie-down point.

Figure 2:
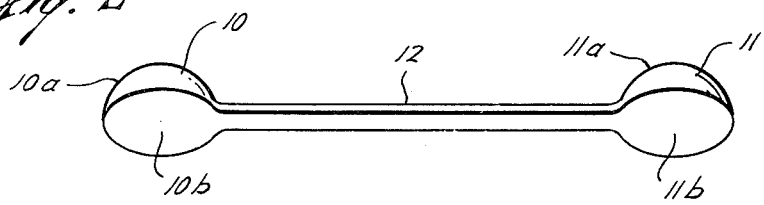
FIG. 2 is a view of a preferred form of the tie-down device of this invention.

Referring now to the drawings, and especially FIG. 2, a device is shown which is adapted to be used to tie down the sheet of flexible material. This device has spaced-apart end portions 10 and 11 connected by an elongate flexible link 12. The end portions 10 and 11 are substantially larger than the part of the link adjacent thereto and each preferably has outer surfaces 10*a* and 11*a* which are rounded and preferably each of the end portions is in a shape of a hemisphere.

Figure 3:
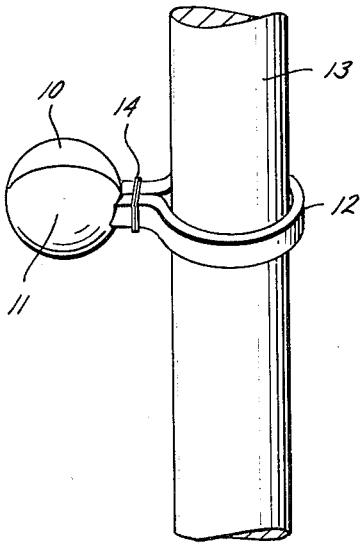
FIG. 3 illustrates the tie-down device of FIG. 2 positioned around a scaffold bar.

With this construction, the tie-down device can have its ends brought together as illustrated in FIG. 3 by flexing the link 12 thereby causing the latter to form a loop which is shown in FIG. 3 as encompassing a scaffold bar 13. Also as illustrated in FIG. 2, the end portions have surfaces 10*b* and 11*b* which preferably are complementary but which, in any event, are engaged with each other when the device is in its FIG. 3 configuration.

To facilitate holding the device in its FIG. 3 position, means can be provided for holding the end portions in their brought-together position and this means can take the form of a rubber band 14 although any other suitable means accomplishing the same purpose can be used. This feature is optional as the device can be manually held in its FIG. 3 position during the time it is being connected to the sheet material.

Figure 4:
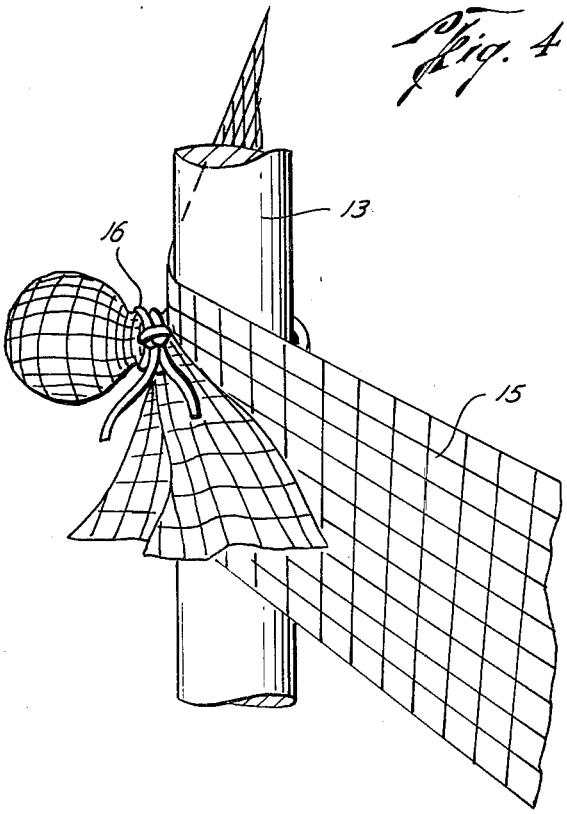
FIG. 4 shows the attachment of the sheet material to the tie-down device illustrated in FIG. 3.

As indicated in FIG. 4, the sheet material 15 is positioned so that it envelopes the brought-together end portions 10 and 11 and then a securing means, such as a cotton cord 16, is applied so as to engage the sheet material at the juncture between the end portions and the link.

Figure 1:
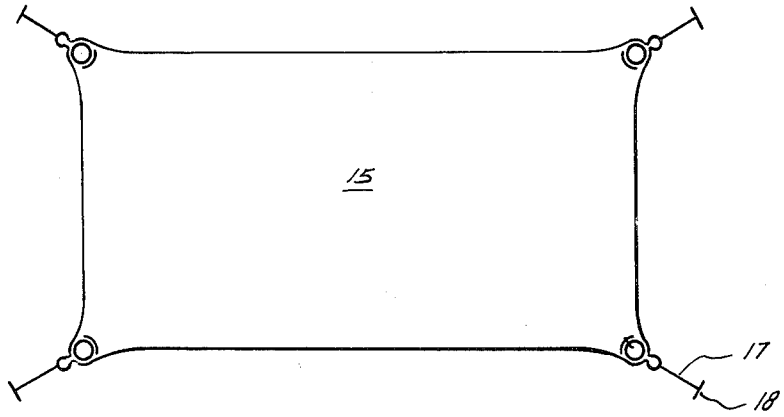
FIG. 1 illustrates a simple covering system in which sheet material is tied down at each of its corners.

Referring to FIG. 1, a sheet of material 15 is illustrated as being tied down at each of its corners by a tie-down device attached thereto in the manner shown in FIG. 4. However, in this instance, the loop formed by link 12 is connected to an anchor point 18 by a cord 17 or other suitable means which extends through the loop of the tie-down device and is tied to the anchor point. The latter can be any convenient member to which a cord can be tied.

Link 12 which joins end portions 10 and 11 must be of such nature as to be flexible to form the loop as illustrated in FIG. 3. Preferably, it is made of an elastomer so that not only can it be readily flexed to form the loop but is also resiliently stretchable lengthwise to provide shock absorption. Thus, when sheet material is, for example, used at construction sites to protect workers from wind or to temporarily cover openings in a building to protect the interior from the weather, the sheet material will be subject to buffeting by winds.

With the link 12 being resiliently stretchable lengthwise, some of the forces caused by this buffeting action can be absorbed by the link thereby decreasing the stress on the sheet material at the locus of the tie down.

The materials from which the end portions 10 and 11 are made is not as important as their shape and size. However, for ease of fabrication, it is preferred that these end portions be made of the same material as link 12, and to be integral therewith. For example, it is preferred that the tie-down device shown in FIG. 2 be made of rubber with the link 12 having a durameter of 65 to 70 and the end portions a durameter of 70 to 75. In a preferred form, the end portions will be hemispheres each having a radius of the order of ¾ to 1 inch and the link can be about ¼ inch thick by ¾ inches wide. Its length can be varied but usually a length of 6 inches will be satisfactory in most applications. These dimensions are merely examplary and can be varied substantially to conform to the requirements of particular installations. However, it is important that the overall size of the brought-together end portions as shown in FIG. 3 be sufficiently larger than the link at the juncture with the end portions that the sheet material can be securely fastened thereto as shown in FIG. 4.

The preferred sheet material for the majority of applications is a plastic sheet reinforced with geometrically or non-randomly arranged strands of high-strength flex resistant fibers, such as cellulose, polyester, polyamide, polyacrylonitrile, polyolefins, etc. Particularly preferred is a flexible plastic sheet consisting of a laminate of two films between which a multiplicity of ordered reinforcing fibers, for example as in a diamond pattern, are arranged so that they move in response to stress patterns, thus supplying reinforcing automatically where most needed to meet stresses. Such arrangements are disclosed in detail in U.S. Pat. No. 2,999,041 to R. P. Lappala.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A system for covering articles or openings comprising, in combination, a flexible sheet material, said sheet material being adapted to be held in protecting position by a binding means secured thereto, said binding means having two end portions connected by a flexible link such that the end portions can be brought together by flexing the link causing the latter to form a loop, the end portions each being substantially larger than the part of the link adjacent thereto, said sheet material enveloping the end portions with the latter being brought-together as aforesaid, and securing means engaging the sheet material at the juncture between the broughttogether end portions and the link to hold the sheet material in enveloping position around said end portions, said link being flexible throughout its length and resiliently stretchable lengthwise.

2. The system of claim 1 wherein said end portions each have rounded outer surfaces in their brought-together position.

3. The system of claim 2 wherein said end portions are each in the shape of a hemisphere.

4. The system of claim 1 wherein means are provided for holding the end portions in their brought-together position prior to their being enveloped by said sheet material.

5. The system of claim 1 wherein said binding means is of an integral, one-piece construction.

* * * * *